United States Patent [19]

Maeda

[11] Patent Number: 4,644,620

[45] Date of Patent: Feb. 24, 1987

[54] DRAW TEXTURING AND ENTANGLEMENT APPARATUS FOR YARN

[75] Inventor: Yoshiyasu Maeda, Yamato Kouriyama, Japan

[73] Assignee: Murata Kikai Kabushiki Kaisha, Kyoto, Japan

[21] Appl. No.: 745,991

[22] Filed: Jun. 14, 1985

Related U.S. Application Data

[63] Continuation of Ser. No. 446,467, Dec. 3, 1982, abandoned.

[51] Int. Cl.[4] ..... D02G 1/20; D02J 1/08

[52] U.S. Cl. ..... 28/220; 28/258; 28/274

[58] Field of Search ..... 28/271, 272, 274, 275, 28/276, 258, 220

[56] References Cited

U.S. PATENT DOCUMENTS

| | | | |
|---|---|---|---|
| 3,026,597 | 3/1962 | Swaney | 28/275 |
| 3,073,000 | 1/1963 | Gonsalves et al. | 28/272 X |
| 3,199,339 | 8/1965 | Lipski | 28/272 X |
| 3,237,269 | 3/1966 | Hawkins | 28/272 |
| 3,971,108 | 7/1976 | Gorrafa | 28/272 |
| 4,188,692 | 2/1980 | Pike | 28/271 |
| 4,422,224 | 12/1983 | Gusack et al. | 28/272 |
| 4,475,693 | 10/1984 | Munro et al. | 28/274 X |

*Primary Examiner*—Robert R. Mackey

*Attorney, Agent, or Firm*—Spensley Horn Jubas & Lubitz

[57] ABSTRACT

Apparatus for the effective manufacturing of bulk yarn employing fluid and comprising two assembled blocks of simple geometric form. The apparatus is characterized by a yarn path part having a polygonal cross section which is defined by planes arranged in the yarn-travelling direction. A part of the yarn path part, however, is provided with a fluid-jetting opening and is constructed with a different cross-section. That part, the yarn-treating section, is defined by curved faces and planes having a cross-section larger than that of the polygonal cross-section of the yarn path part. The bottom part of the yarn treating section has a curved face with said fluid-jetting opening therein, a separate covering part encloses the yarn path part to tunnel-like member.

24 Claims, 12 Drawing Figures

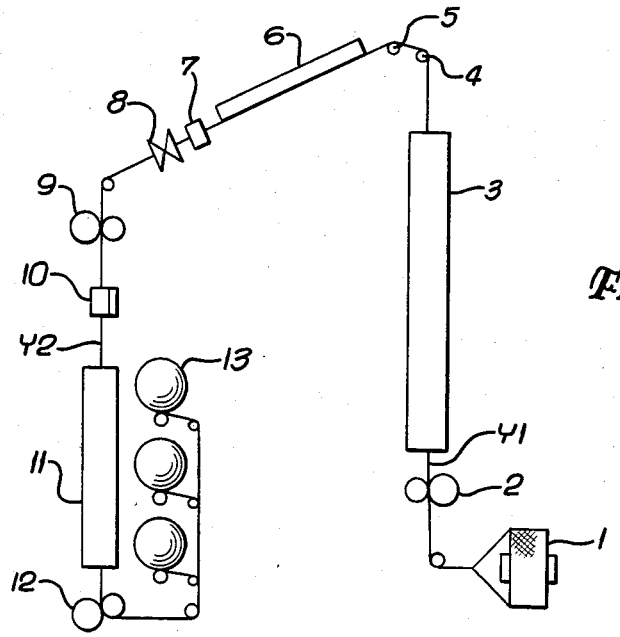
Fig. 1
Fig. 2
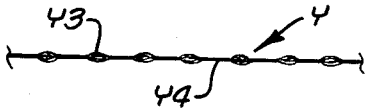
Fig. 3
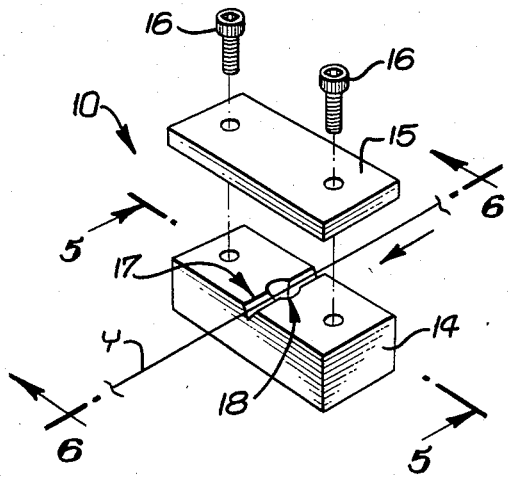
Fig. 4
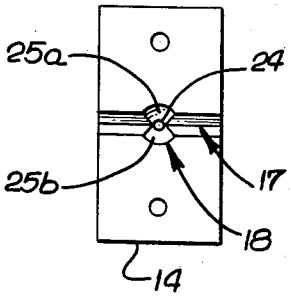

DRAW TEXTURING AND ENTANGLEMENT APPARATUS FOR YARN

This application is a continuation of co-pending application Ser. No. 446,467, filed Dec. 3, 1982, now abandoned.

BACKGROUND OF THE INVENTION

1. Field of the Invention

The present invention relates to an apparatus for producing bulked yarn by way of treating multifilament yarn with fluid.

2. Description of the Prior Art

Techniques for imparting compactness to a multifilament yarn in which the yarn is subjected to action of turbulent fluid are well-known in prior art. Examples are U.S. Pat. Nos. 2,036,838, 4,063,338, 3,823,449, and 4,251,904. The purpose of such a yarn treating apparatus is to obtain a synthetic multifilament yarn which offers bulkiness, compactness and convenience in further processing. These qualities are best achieved if open thick yarn portions and compact entangled portions appear alternately. The larger the number of entangled portions per unit length is, the stronger the final yarn product becomes.

An air or fluid jet apparatus is preferrably employed to obtain these qualities since alternative methods such as twisting or sizing procedures have several disadvantages. If the yarn is sized, it is necessary to wash the textiles fabricated therefrom in order to remove paste. If the yarn is twisted, a twisting machine will be required. In any event, the number of treating processes will be increased, the production cost will be increased, a rewinding process will be required, and the probability that the yarns will be injured is higher. The fluid jetting apparatus avoids these procedures and obtains the entanglements by fluid turbulence in the yarn path of the apparatus. Such fluid jetting methods enable one to obtain a product of the same quality as twisted yarns with the separation of filaments being controlled in spite of being untwisted.

However, the treating of yarn with fluid has created several problems in connection with certain conventional apparatuses. While the processability of the yarn may be enhanced by imparting compactness and cohesiveness to the yarn by interlacing individual filaments in the yarn, the bulkiness of the yarn decreases and the appearance of a fabric made with such yarn deteriorates as the processability is enhanced. The relationship between bulkiness and processability is more advantageous if the entangled and not entangled portions appear regular and if the number of entangled portions per unit length is high. Although conventional apparatus try to obtain a more satisfying relationship between bulkiness, processability and cost, they have been less successful than the present invention. One reason for such limited success of prior art apparatus might be that in almost all of such conventional apparatus, the yarn path enclosure is cylindrical in form. The cylindrical enclosure is provided with an air jetting port for jetting air onto the yarn, e.g. U.S. Pat. Nos. 4,188,692, 4,070,815, 4,064,686, 4,063,338 and 4,138,840. The specific construction of such conventional apparatus differs. For example, the length or diameter of the cylindrical enclosure may be changed, or a slit may be formed along a longitudinal direction of the cylindrical enclosure in order to make the passage of yarn easy.

Nevertheless, they offer the problem that the consumption of air or fluid and the necessary pressure is too high compared with the achieved number of entangled portions and the strength of these portions. In addition, the entanglement is not solid enough, and tension and relaxation with only small force extinguishes the entangled structure of the yarn and the gathering property is frequently lost.

It is an object of the present invention to solve the above described defects and to obtain with a smaller quantity of fluid a yarn which has a high number of entangled portions of good quality and processability. The special, although simple, construction of the invented apparatus enables one to achieve these advantages. Instead of being cylindrical, the enclosure is formed by a yarn path part in the present apparatus, which part is defined by planes arranged in the yarn traveling direction. In the preferred form, the enclosure has a triangular cross-section. This form of yarn path enclosure insures a uniformly interlaced yarn because it avoids the unidirectional and continuous rotation during the interlacing procedures. One prior art device that employs a similar construction of the yarn path enclosure is U.S. Pat. No. 4,251,904. However, in contrast to the present invention, the yarn path part of the present invention is interrupted by an intersection which constitutes the yarn treating section and is defined by curved faces and planes having a cross-section larger than that of the polygonal part (e.g., triangular cross-section) of the yarn path part. The specific construction of that portion of the yarn path effectivates the desired mode of entanglement as described below.

All other known prior art differ even more than the aforementioned patent from the present invention. For example, in U.S. Pat. No. 4,064,686, the yarn treating portion of the yarn part is also larger than the other portions, but the whole yarn path is solely cylindrical.

BRIEF DESCRIPTION OF THE DRAWINGS

FIG. 1 illustrates schematically a layout of a false twisting machine to which an apparatus of the present invention is applied.

FIG. 2 illustrates schematically the yarn obtained by means of an apparatus as shown in FIG. 1.

FIG. 3 is a perspective view showing one preferred embodiment of an apparatus for treating yarn with fluid according to the present invention.

FIG. 4 is a plan view showing the bottom member of the embodiment of FIG. 3.

BRIEF DESCRIPTION OF THE INVENTION

Figure 5:
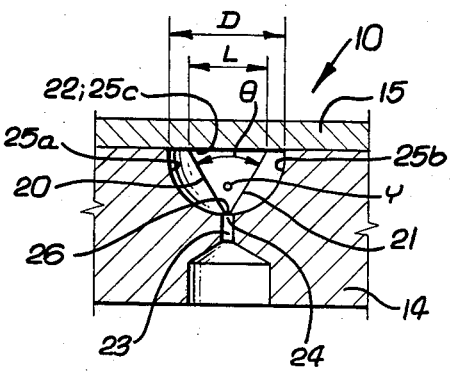
FIG. 5 is a sectional front view of an apparatus as shown in FIG. 3 along the lines 5—5.

The entanglement apparatus of the present invention comprises a yarn path part having a polygonal section (e.g., triangular shape) that is formed by planes arranged in the yarn travelling direction. In the vicinity of its central portion, the yarn path part is provided with a fluid jet. The fluid jet has curved surfaces in proximity thereto which may be a spherical section ("yarn treating section") with a cross-sectional area larger than that of the polygonal part of the yarn path part. Individual filaments of a multifilament yarn passing the yarn treating section are subjected to a different swirling action and disturbing action than those placed in the polygonal part of the yarn path part. Thus, while the multifilament yarn is subjected to the action of rapidly injected flow in the yarn treating section of the yarn path part, the yarn simultaneously collides with the side walls of the polygonal portion of the yarn path part which promote the forming of entanglements. The resulting bulk yarn is produced at a lower consumption of fluid, and its quality is better than the quality of bulk yarn produced by means of a conventional apparatus. Thus the apparatus of the present invention is remarkably more effective.

DETAILED DESCRIPTION OF THE DRAWINGS

FIG. 1 shows one example of the layout of a false twisting machine in which the apparatus of the present invention may be applied.

A yarn $Y_1$ is pulled out from a yarn-feeding package 1 by means of a first feed roller 2 and travels vertically through a heater 3, direction-changing rollers 4 and 5, a balloon-regulating plate 6 and a cooling apparatus 7 to be cooled to the desired temperature. The yarn $Y_1$ is then introduced to a conventional false twisting unit 8 of pin type, belt type, friction type and the like to be false twisted. The drawn and false-twisted yarn $Y_1$ then travels to an apparatus 10 of the present invention by means of a guide and the second feed roller 9. By treating with fluid, the multifilament yarn $Y_1$ leaves the apparatus 10 as an entangled bulky yarn $Y_2$. It is pulled through a second heater 11 by means of the third roller 12 and wound around a winding package 13. The result is a false twisted bulk yarn as schematically shown in FIG. 2. Open thick yarn portions $Y_3$ and entangled portions $Y_4$ appear alternately. The entangled portions $Y_4$ guarantee convenience in further processing, and the larger the number of entangled portions $Y_4$ per unit length is, the stronger the yarn becomes. Therefore, the single filaments can be effectively prevented from being separated in the subsequent processes.

FIGS. 3 and 4 show a preferred embodiment of apparatus 10. The apparatus has a simple geometrical construction; it consists of two blocks 14 and 15 and bolts 16 for joining block 14 to block 15. The block 14 forms the yarn path part having a polygonal cross-section which preferably is triangular and forms a triangular channel or trough 17. The channel is defined by planes or walls arranged in the yarn traveling direction. A curved yarn treating section 18 is formed in the triangular channel. Block 15 has the function of closing the top side of the yarn path block 14 and the yarn treating section 18 to form a yarn path enclosure or tunnel. FIG. 4 is a plan view on the surface of block 14 of the apparatus.

Figure 6:
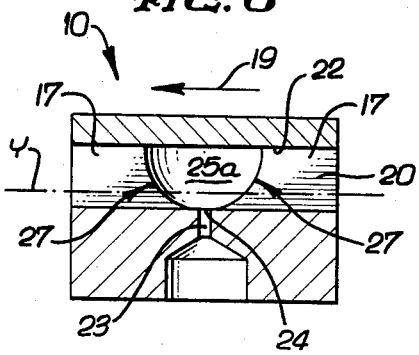
FIG. 6 is a sectional side view of an apparatus as shown in FIG. 3 along the lines 6—6.

FIGS. 5 and 6 are sections of the same preferred embodiment of the present invention as shown in FIGS. 3 and 4. FIG. 5 is a sectional view of yarn path block 14 taken along the lines 5—5 of FIG. 3. FIG. 6 is a sectional view of yarn path block 14 taken along the lines 6—6 of FIG. 3. Yarn path block 14 and block 15 form a triangular enclosure surrounded by three side walls 20, 21 and 22 parallel to the yarn-travelling direction 19. At its central portion, the yarn path is provided with an air jet 23. The exit of the air jet 24 is surrounded by curved surfaces **25*a* and 25*b*, having a spherical section extending beyond the side walls 20 and 21**.

The yarn path enclosure has a cross-section in the form of an isosceles or regular triangle with the summit or apex 26 formed in the yarn path block 14. The diameter of the spherical yarn treating section is larger than the length L of said triangle; preferably the diameter D is 1.25 to 2.1 times of length L. Accordingly, the spherical yarn treating section 18 of the yarn path block 14 has a larger section than triangular channel 17.

Thus compressed air injected through the air jet 23 collides with the wall 22 and spreads toward both sides to generate swirling flow or turbulent flow. That causes the entanglement of the bundle of filaments in the following way. While the bundle of filaments Y is swirled along the spherical side walls **25*a* and 25*b* in the yarn treating section 18, and disturbed at random in the range surrounded by said side walls 25*a* and 25*b* and said plane 22 by action of the injected air, the entanglement of the filaments Y is promoted by forces acting on the filaments Y at the boundary portions 27, 27. The forces acting at the boundary portions 27, 27 between the triangular part of the yarn path and the spherical part of the yarn path are created by the triangular part surrounding the spherical part and having a smaller cross-section than the cross-section of the spherical part of the yarn path. In addition, the routes of yarns are stabilized and the yarns are effectively guided while travelling since both parts of channel 17, 17 have a triangular section. The operation of the subject invention may also be explained as resulting from the filling of the entangled yarn treating section 18 with turbulent yarn until the feeding of the yarn into section 18 develops a force which expels the yarn from section 18. The expelling of the yarn from section 18** may carry with it a section not subject to the same treatment. The precise nature of exactly what happens is not yet fully understood. It is only clear that the results from the invention are suprisingly superior.

Figure 7:
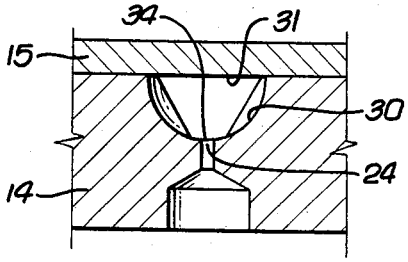
FIG. 7 is a sectional front veiw showing another preferred embodiment of an apparatus for treating yarn with fluid according to the present invention.
Figure 8:
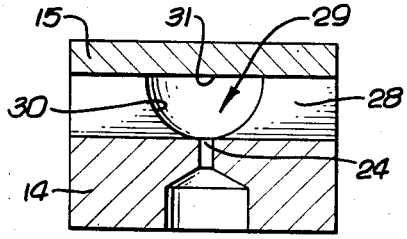
FIG. 8 is a sectional side view illustrating an apparatus as shown in FIG. 7.

Contrary to a conventional apparatus, an apparatus of the present invention does not require guide members for controlling the passage of the yarn at the input side and output side of the apparatus and for achieving the desired results. The desired number of entangled portions, or the number of entangled portions per unit length, or the entangling strength, can be achieved regardless of the absence of guide members. FIGS. 7 and 8 show another preferred embodiment of the present invention. The yarn path block 14 has an inverse trapezoidal section or channel 28 and a yarn treating section 29. The section 29 is composed of a curved surface 30 forming a spherical section, and from a plane 31 formed by block 15 similarly to the above described preferred embodiment. The sectional area of the yarn treating section 29 again is larger than that of the polygonal yarn channel 28.

Figure 9:
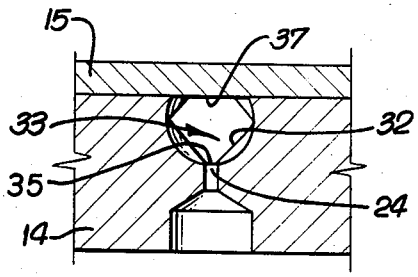
FIG. 9 is a sectional frontal view showing still another preferred embodiment of an apparatus for treating yarn with fluid according to the present invention.
Figure 10:
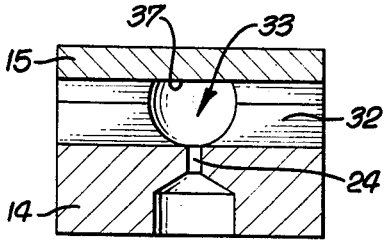
FIG. 10 is a sectional side view illustrating an apparatus as shown in FIG. 9.

FIGS. 9 and 10 show still another preferred embodiment of the present invention. The yarn path block 14 has an almost pentagonal channel 32 and a yarn treating section 33 again composed from a curved surface yarn treating section forming a spherical section and a plane 37 formed by block 15 with the air jet exit 24 at the bottom portion of section 33 similar to the above described embodiments.

The described embodiments of the present invention have in common that the exit 24 of the air jet on the bottom of the spherical section is placed at the same level as the bottom portions 26, 34 and 35 of the yarn passages 17, 28 and 32 of the different embodiments, and at least one summit of said polygon touch internally with a part of an imaginary circular arc of the yarn treating section thereof. Further in all of the embodiments, the yarn channels 17, 28 and 32 have a cross-sectional area less than that of the yarn treating section, the walls of the channels 17, 28 and 32 are in the direction of yarn travel and form a trough for support of the yarn.

Experimental examples in case of using a false twisting machine as shown in FIG. 1 to which an apparatus of the present invention is applied, will be demonstrated below:

EXAMPLE 1

Figure 11:
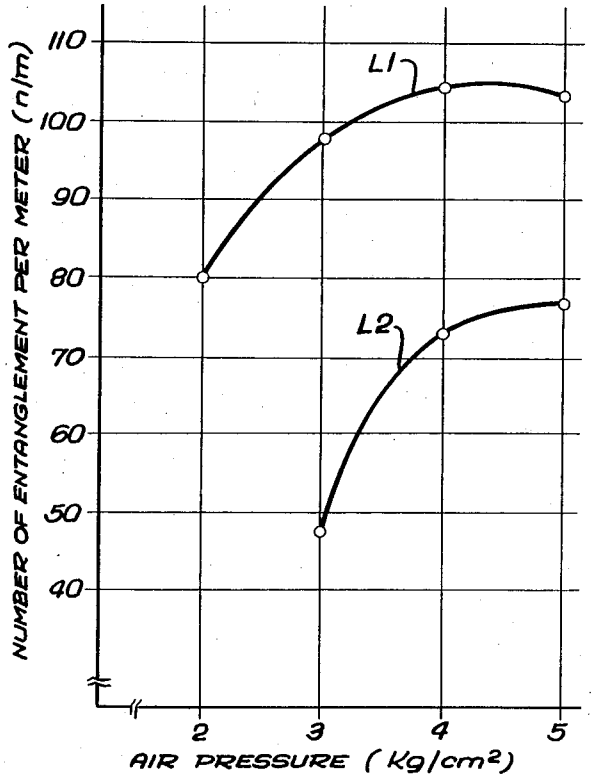
FIG. 11 is a graph showing the relationship between the air pressure and the number of entangled portions of yarns for the case of using an apparatus for treating yarn with fluid as shown in FIGS. 5 and 6 and the case of using certain conventional apparatus.

FIG. 11 shows the correlation between the air pressure (kg/cm$^2$) and the number of entangled portions (n/m) for polyester yarn of SD (Semi-Dull) of 225/150/48 (treated yarns of 150 denier obtained from a bundle of filaments of 225 denier consisting of 48 filaments) treated by means of an apparatus as shown in FIGS. 5 and 6. The diameter of the exit of the air jet is 1.4 mm, the diameter of the yarn treating portion is 2 mm, the angle $\theta$ of the yarn path channel 60°, the speed of yarn within the channel is 600 m/min, and the overfeed coefficient of the second feed roller 9 and the third feed roller 12 is 2%.

The graph L1 signifies the relation between pressure and number of interlaced portions for an apparatus according to the present invention, while the graph L2 shows the relation for the case of using a conventional apparatus with cylindrical yarn path channel. The graphs L1 and L2 demonstrate that the number of entangled portions is 80/m at the air pressure of 2 kg/cm$^2$ for the case of an apparatus of the present invention, while there are scarcely any entangled portions for the case of using the conventional apparatus. In addition, it is clearly found that the number of entangled portions is 98/m for the case of using an apparatus of the present invention which is about two times of the number of entangled portions for the case of a conventional apparatus of 48/m, at the air pressure of 3 kg/cm$^2$. Thus, for the same air pressure, an apparatus of the present invention is capable of achieving a remarkably larger number of entangled portions than the conventional apparatus. Further, an apparatus of the present invention requires an air pressure of only 2 kg/cm$^2$ in order to achieve the number of entangled portions of 80/m while the conventional apparatus requires for the same number an air pressure of about 5 kg/cm$^2$. Consequently, the air consumption of an apparatus of the present invention is $\frac{1}{2}$ times that of the conventional apparatus and therefore, its efficiency is higher.

EXAMPLE 2

Figure 12:
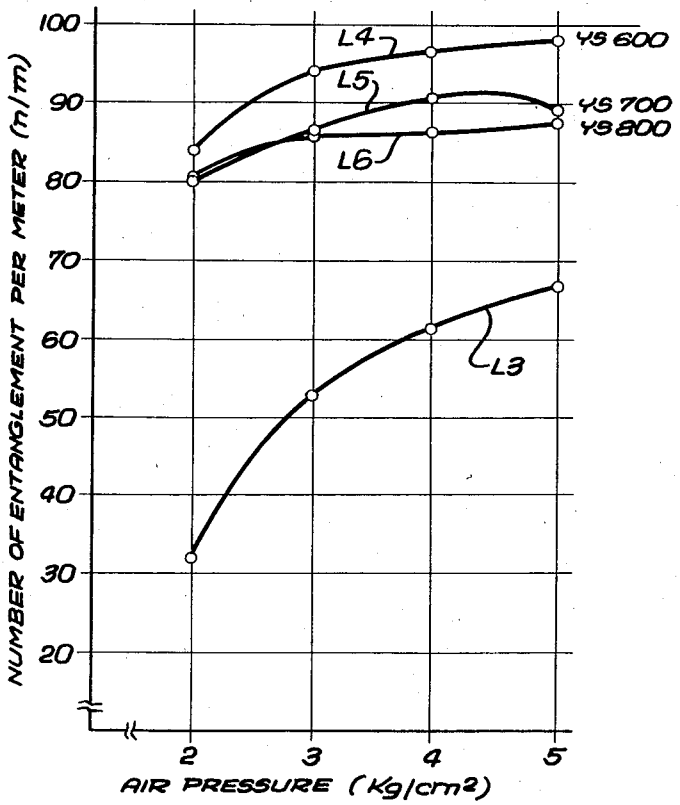
FIG. 12 is a graph showing the relationship between the air pressure and the number of entangled portions of yarns obtained from similar experiments to those as shown in FIG. 11 excepting yarns to be treated and the speed of yarns are changed.

FIG. 12 shows the relationship between the air pressure and the number of entangled portions for the second experimental example in which polyester yarns of 115/75/36 SD (Semi-Dull) are treated by means of the same apparatus. The line L3 shows the relation between the air pressure and the number of entangled portions at the yarn speed of 600 m/min for a conventional apparatus. The lines L4, L5 and L6 show the relationship between the air pressure and the number of entangled portions at the yarn speed of 600 m/min, 700 m/min, and 800 m/min, respectively.

According to an apparatus of the present invention, the number of entangled portions of 80 to 118/m can be achieved at an air pressure of 2 to 5 kg/cm$^2$ for every yarn speed which is remarkably larger than that in cases of the conventional apparatus. In addition, it is found that an apparatus of the present invention can achieve a sufficient number of entangled portions even at the increased yarn speed. Thus, high speed treatment is possible.

It should be appreciated that the subject invention may be implemented by various mechanical arrangements and forms. These changes may be made consistent with the invention so long as the general vibrating action imparted to the yarn is not substantially altered.

I claim:

1. An apparatus for entangling yarn including a device comprising:

(a) a yarn path part block having a channel formed in a surface thereof so as to have at least two different cross-section portions; (1) one portion, in the form of a yarn path channel, having a first cross-section which is defined by at least one planar wall arranged longitudinally in the yarn travelling direction; and (2) another portion, forming a yarn treating section, formed continuous with and intermediate along the yarn path channel, such portion defined by a curved surface forming a second cross-section having a larger cross-sectional area than the first cross-section, with at least one fluid jet opening in the vicinity of the bottom of said curved surface;

(b) means for enclosing said at least two different cross-section portions of said yarn path part block to form therewith a tunnel-like structure, said fluid jet opening lying in the plane defined by the longitudinal surface of said yarn path channel which is furthest from said means for enclosing said cross section portions; and (c) means for supplying a fluid to said at least one fluid jet opening;

wherein at least one edge of said planar wall of said yarn path channel is tangent to the imaginery arc of the curved surface of said yarn treating section; whereby a yarn having alternating entangled portions and open portions is produced.

2. The apparatus of claim 1 wherein the first cross-section if polygonal, such that one side of the polygon is formed by said means for enclosing said at least two different cross-section portions of said yarn path part block.

3. The apparatus of claim 2 wherein the second cross-section is circular and forms a spherical section.

4. The apparatus of claim 2 wherein the polygonal cross-section is a triangle having one side thereof formed by said means for enclosing said at least two different cross-section portions of said yarn path part block.

5. The apparatus of claim 4 wherein the triangular cross-section has one corner thereof generally aligned with said at least one fluid jet opening.

6. The apparatus of claim 4 wherein the second cross-section is circular and forms a spherical section.

7. The apparatus of claim 6 wherein the ratio of the diameter of the circular second cross-section to the length of the largest side of the triangle of the first cross-section is between 1.25 and 2.1, and wherein no side of the triangle has a length more than 50% longer than any other side.

8. An apparatus according to claim 6 wherein the at least one fluid jet opening in said yarn treating section is disposed and oriented to cause the yarn passing through the yarn path part block to be subjected to a swirling and disturbing action along the walls of the spherical section while simultaneously utilizing the wall planes of the triangular channel of the yarn path part block to promote entanglement by frictional force.

9. The apparatus of claim 2 wherein the polygonal cross-section is a trapezoid having one side thereof formed by the means for enclosing said at least two different cross-section portions of said yarn path part block.

10. The apparatus of claim 9 wherein the second cross-section is circular and forms a spherical section.

11. The apparatus of claim 2 wherein the polygonal cross-section is substantially pentagonal in shape; said pentagon having one side thereof formed by the means for enclosing said at least two different cross-section portions of said yarn path part block.

12. The apparatus of claim 11 wherein the second cross-section is circular and forms a spherical section.

13. The apparatus of claim 1 wherein the second cross-section is circular and forms a spherical section.

14. The apparatus of claim 1 wherein the means for enclosing the at least two different cross-section portions of said yarn path is a separate member removably fastened to said yarn path part block.

15. The apparatus of claim 1 wherein the at least one planar wall is parallel to the yarn travel direction.

16. A draw texturing apparatus for producing a yarn having alternating entangled portions and open portions comprising:

(a) a draw texturing means for draw texturing multifilament yarn, having feed rollers at the output thereof;

(b) an air entanglement device comprising: (1) a yarn path part block having a channel formed in a surface thereof so as to have at least two different cross-section portions; including, (1) one portion, in the form of a yarn path channel, having a first cross-sectional area which is defined by at least one planar wall arranged longitudinally in the yarn travelling direction, and (2) another portion, forming a yarn treating section, formed continuous with and intermediate along the yarn path channel, such portion, defined by a curved surface forming a second cross-section having a larger cross-sectional area than the first cross-section, with at least one fluid jet opening in the vicinity of the bottom of said curved surface;

(c) means for enclosing said at least two different cross-section portions of said yarn path part block to form therewith a tunnel-like structure, said fluid jet opening lying in the plane defined by the longitudinal surface of said yarn path channel which is furthest from said means for enclosing said cross-section portions; and (d) means for supplying a fluid to said at least one fluid jet opening;

said device receiving said multifilament yarn from said feed rollers;

wherein at least one edge of said planar wall of said yarn path channel is tangent to the imaginery arc of the curved surface of said yarn treating section.

17. The apparatus of claim 16 further comprising a second pair of feed rollers at the input thereof, wherein an overfeed coefficient of the input feed rollers with respect to the output feed rollers is at least 2%.

18. An apparatus for entangling yarn comprising:

a first surface, a second curved surface in communication with said first surface, said first and second surfaces together forming a yarn treatment enclosure, a fluid jet in communication with said yarn treatment enclosure at a first communication location, said first communication location being coincident with the point on said second surface which is the furthest from said first surface, a yarn channel longitudinally disposed on opposite sides of said yarn treatment enclosure and communicating with said yarn treatment enclosure, said yarn channel comprising a plurality of walls, said walls being in abutment along their edges and defining at least one longitudinal surface spaced from said first surface, said first communication location lying in the plane defined by the longitudinal surface of said yarn channel which is furthest from said first surface, said yarn channel having cross sectional area which is less than that of said yarn treatment enclosure, whereby a yarn having alternating entangled portions and open portions is produced.

19. An apparatus as in claim 18 wherein said first surface is planar.

20. An apparatus as in claim 18 wherein said second curved surface is spherical.

21. An apparatus as in claim 18 wherein said yarn channel has a cross section which is polygonal.

22. An apparatus as in claim 21 wherein said yarn channel has a cross section which is triangular and wherein said second curved surface is spherical and wherein the ratio of the diameter of said spherical surface to the length of the largest side of said triangular cross section is between 1.25 and 2.1 and wherein no side of said triangular cross section has a length more than 50% longer than any other side.

23. An apparatus as in claim 21 wherein at least one of said edges of said yarn passage walls is tangent to the imaginary arc created by the intersection of the curve defined by said second surface.

24. A draw texturing apparatus for producing a yarn having alternating entangled portions and open portions comprising:

a draw texturing means for draw texturing multifilament yarn having feed rollers at the output thereof;

an air entanglement device, said air entanglement device comprising:

a first surface, a second curved surface in communication with said first surface, said first and second surfaces together forming a yarn treatment enclosure, a fluid jet in communication with said yarn treatment enclosure at a first communication location, said first communication location being coincident with the point on said second surface which is furthest from said first surface, a yarn channel longitudinally disposed on opposite sides of said yarn treatment enclosure and communicating with said yarn treatment enclosure, said yarn channel comprising a plurality of walls, said walls being in abutment along their edges and defining at least one longitudinal surface spaced from said first surface, said first communication location lying in the plane defined by the longitudinal surface of the said yarn channel which is furthest from said first surface, said yarn channel having a cross sectional area which is less than that of said yarn treatment enclosure, said air entanglement device receiving said multifilament yarn from said feed rollers.

* * * * *